US007288708B1

(12) United States Patent
Kassabian

(10) Patent No.: US 7,288,708 B1
(45) Date of Patent: Oct. 30, 2007

(54) SWIVELING PERCUSSION STAND

(76) Inventor: Todd M. Kassabian, 6 Tyne Ct., Kenall Park, NJ (US) 08824

( * ) Notice: Subject to any disclaimer, the term of this patent is extended or adjusted under 35 U.S.C. 154(b) by 51 days.

(21) Appl. No.: 11/305,439

(22) Filed: Dec. 19, 2005

(51) Int. Cl.
*G10D 13/02* (2006.01)

(52) U.S. Cl. ..... 84/422.1

(58) Field of Classification Search ..... 84/421, 84/422.1, 422.2, 422.3
See application file for complete search history.

(56) References Cited

FOREIGN PATENT DOCUMENTS

DE 3520837 C1 * 10/1986

* cited by examiner

*Primary Examiner*—Kimberly Lockett

(74) *Attorney, Agent, or Firm*—William W. Haefliger

(57) ABSTRACT

A swiveling cymbals stand, comprising a stand lower portion, and leg means supporting the lower portion to extend upright; a stand upper portion to carry cymbals including discs one of which is movable relative to the other; a swivel joint interconnecting upper and lower portions, allowing the upper portion to be displaced to a selected angle from vertical and to a selected azimuth angle, and to remain at angles; and means for operating the cymbals including an actuator extending through the swivel joint, the swivel joint including ball and socket elements, having variable relative positions corresponding to stand upper portion selected angularity.

12 Claims, 7 Drawing Sheets

SWIVELING PERCUSSION STAND

BACKGROUND OF THE INVENTION

This invention relates generally to adjustment of percussion instrument stands, such as cymbal stands, and more particularly to controllable tilt angularity of instruments carried on such stands.

There is frequent need for tilt adjustment of the upper portions of cymbals stands to present the cymbals at selected tilt angularity relative to the player or user. What is needed is a simple, effective and reliable adjustment means that is easy and quick to operate or adjust. No prior apparatus of which I am aware incorporates the multiple advantages in construction, operations and results which are now provided by the present invention.

SUMMARY OF THE INVENTION

It is major object of the invention to provide an improved swiveling stand meeting the above needs. Basically, the stand assembly comprises, in combination:

a) a stand lower portion, and leg means supporting said lower portion to extend upright, b) a stand upper portion to carry a percussion instrument such as cymbals one of which is movable relative to the other, c) a swivel joint interconnecting said upper and lower portions, allowing the upper portion to be displaced at a selected angle from vertical and at a selected azimuth angle, and to remain at said angles, d) and means for operating said instrument including an actuator extending through said swivel joint, e) said swivel joint including ball and socket elements, having variable relative positions corresponding to stand upper portion selected angularity.

Accordingly, the stand upper portion carrying the instrument or the cymbals can be accurately and quickly displaced to selected angularity from vertical, and to selected azimuth, by selective adjustment of the ball and socket swivel joint, below the stand upper portion.

It is another object of the invention to provide ball and socket elements that have through openings to pass the actuator, as for example a cable that is operated by a foot pedal associated with the stand.

A further object includes provision of an adjustably tightenable clamp by which friction between the ball and socket, that provides resistance to pivoting, can be adjusted. As will be seen, the clamp may be integrated with the socket element, to adjustably grip the ball. For example, the ball typically has an outer surface and the clamp adjustably engages that outer surface.

These and other objects and advantages of the invention, as well as the details of an illustrative embodiment, will be more fully understood from the following specification and drawings, in which:

DRAWING DESCRIPTION

DETAILED DESCRIPTION

Figure 1:
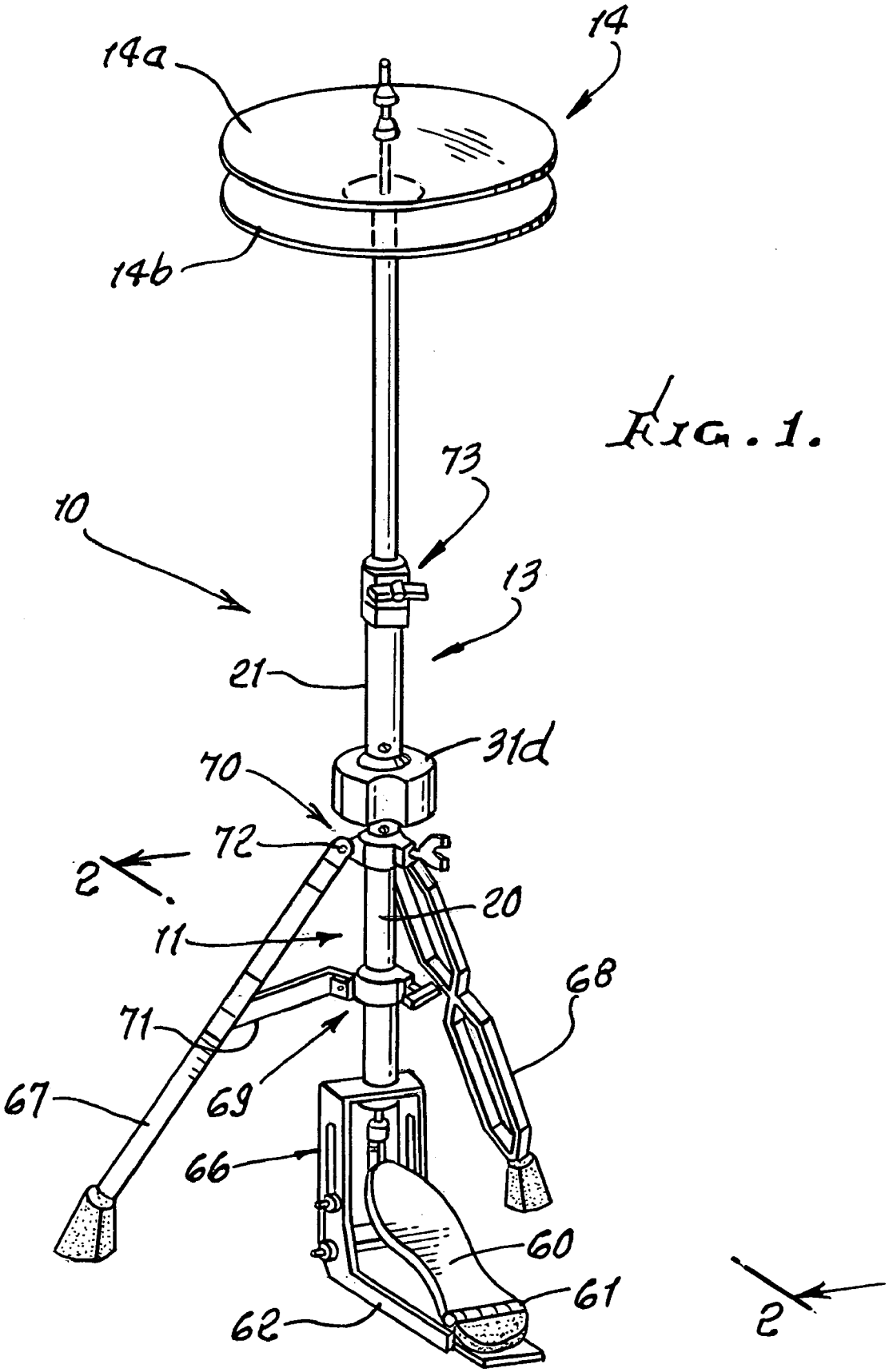
FIG. 1 is a front elevation, in perspective, showing a cymbals stand incorporating the invention.

In the drawings, a preferred cymbals or percussion instrument 10 has an upright lower portion generally indicated at 11, and leg means supporting that lower portion. The stand also includes an upper portion 13 that carries cymbals 14 including an upper cymbals disc 14*a* movable up and down relative to a lower cymbals disc 14*b*, and to engage the latter. Disc 14*b* is carried by 13.

Figure 4:
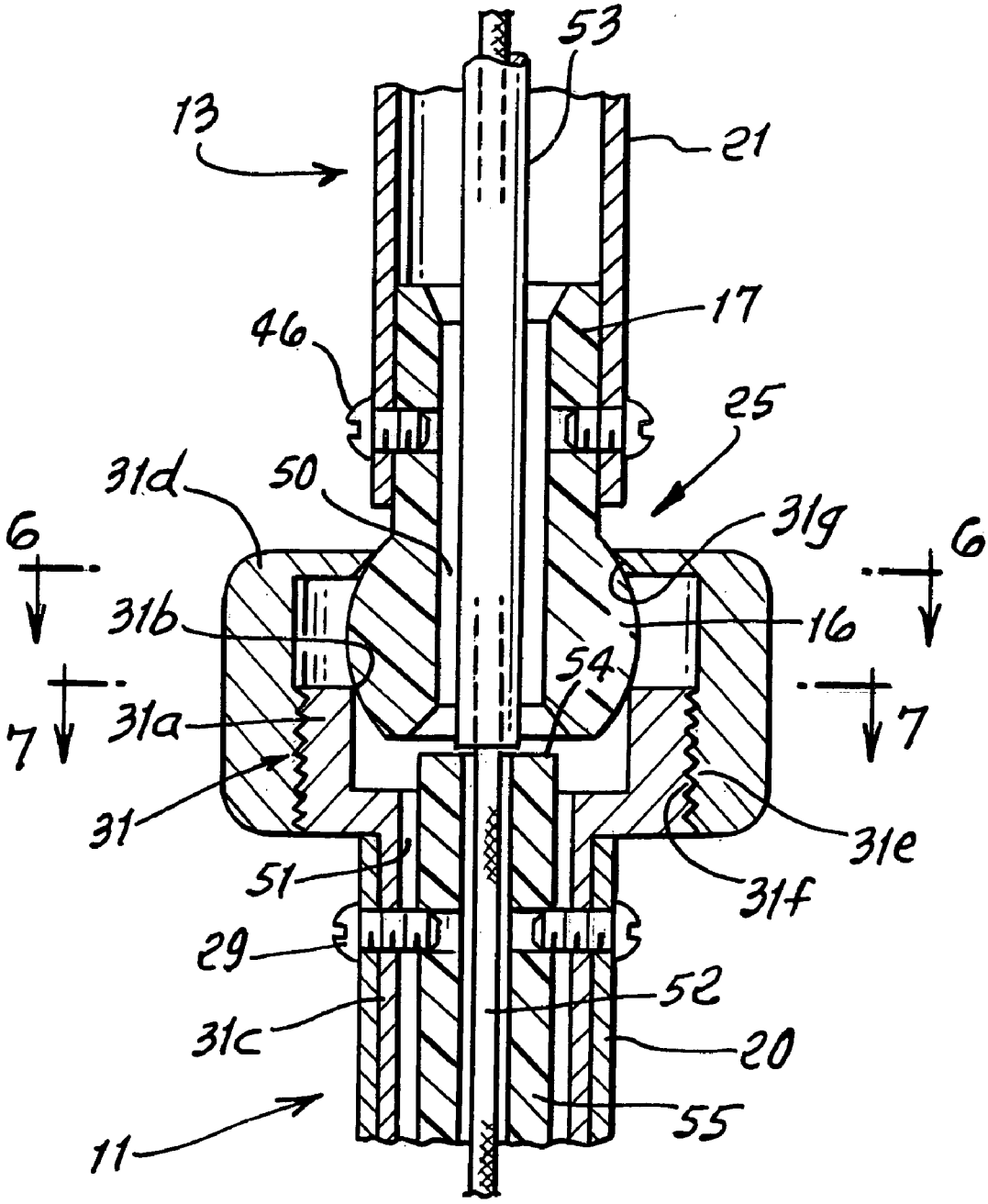
FIG. 4 is an enlarged fragmentary section, taken on lines 4-4 of FIG. 2.
Figure 5:
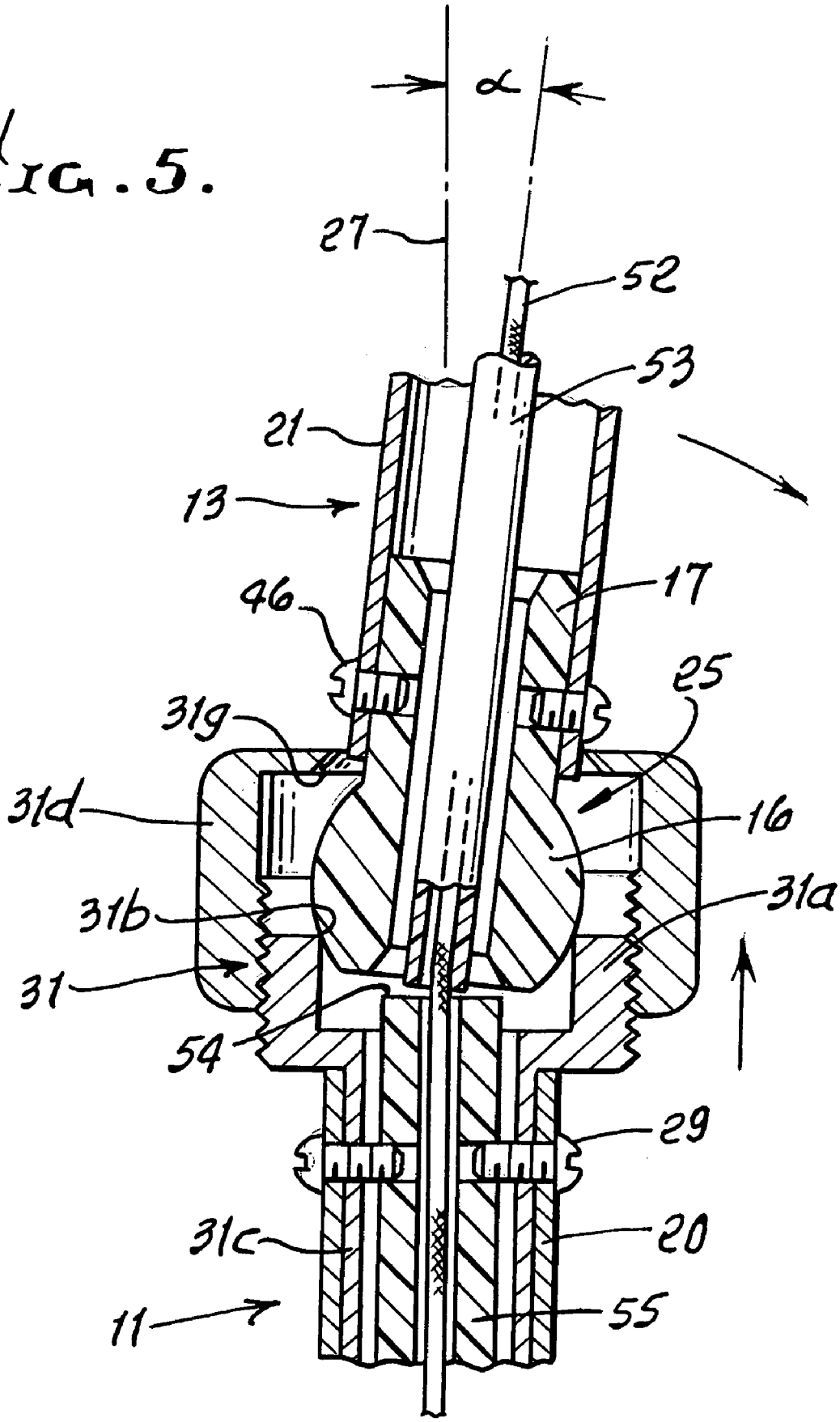
FIG. 5 is a view like FIG. 4, showing a tilting mode with loosened clamping.

As shown in FIGS. 4 and 5, the stand lower portion 11 may include a lower upright tube 20, and the stand upper portion 13 may include an upper tube 21 that can be tilted, as for example universally, in different directions, i.e. at different azimuth angles.

A swivel joint, indicated at 25, is configured to connect the stand lower and upper portions, as via their associated tubes 20 and 21, allowing the upper portion 13 to be easily displaced at or to a selected angle from vertical, and at a selected azimuth angle, i.e. in a selected lateral direction, and to remain at that tilt configuration best suited to the player or user, who normally is also playing a drum set.

Figure 6:
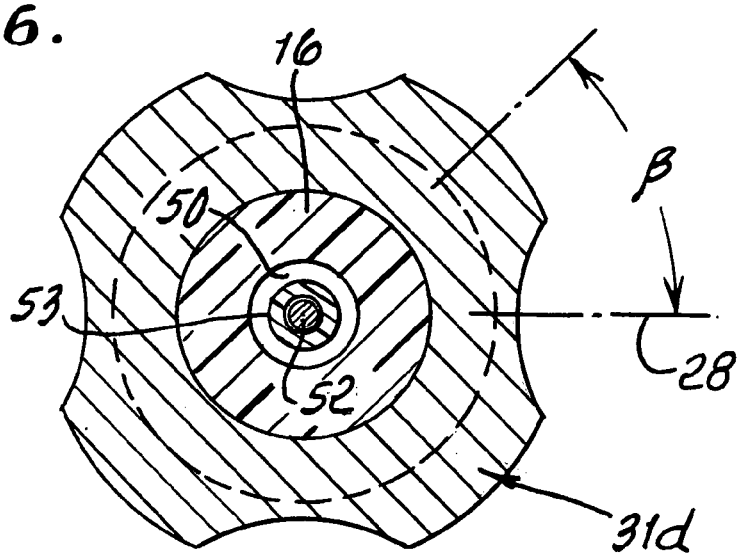
FIG. 6 is a horizontal section taken on lines 6-6 of FIG. 4.
Figure 9:
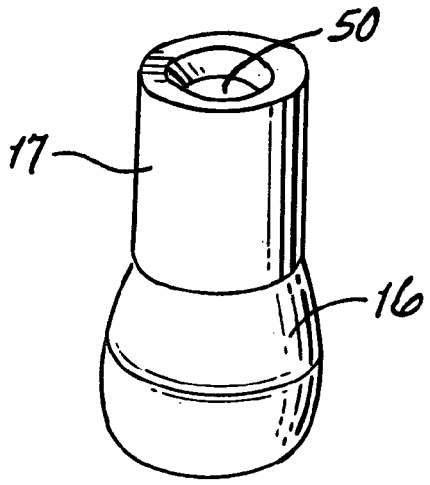
FIG. 9 is a perspective view of a ball and stem that swivels relative to a socket.
Figure 7:
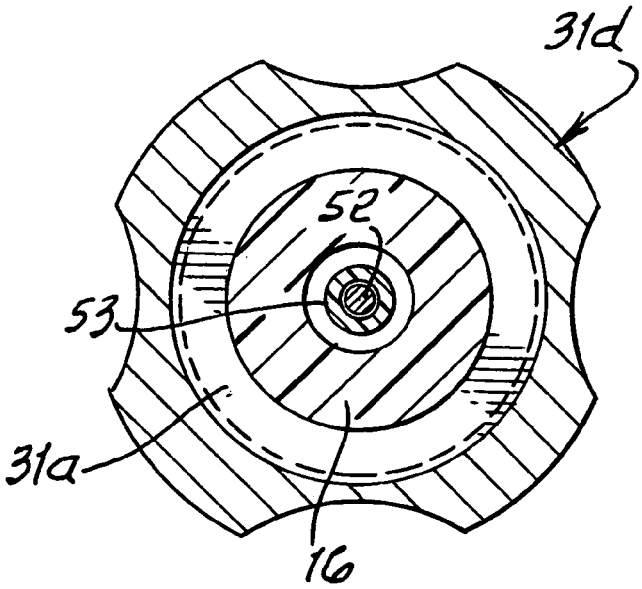
FIG. 7 is a horizontal section taken on lines 7-7 of FIG. 4.

The swivel joint preferably includes ball and socket elements, having variable relative positions corresponding to the stand upper portion 14 selected angularity a from vertical (see FIG. 5) and azimuth angularity, i.e. directional angularity β about vertical axis 27 defined by the stand lower portion 11. FIG. 6 shows directional angularity β, which can vary between 0 and 360° relative to a base lateral direction 28. As shown, a ball element 16 is received within a socket element 31, to swivel in or relative to the element 31. The socket includes a first part 31*a* defining a seat 31*b* for engaging the ball or bulbous body in its various positions, that seat for example being annular. Part 31*a* includes a tubular stem 31*c* receivable within lower tube 20 and connected via fasteners 29 to that tube.

The socket also includes a second part 31*d* movable in one direction to clamp the ball against the seat 31*b* in its selected swiveled position, and movable in another, for example opposite direction to loosen the ball, allowing ball swiveling relative to the seat, to another selected position. The second part 31*d* may be rotatably supported by the first part, as by interengaged threads 31*e* and 31*f*. Parts 31*d* and 31*a* are typically tubular. Part 31*d* may have an annular clamping surface 31*g* that tightens against the ball surface or surfaces, as seen in FIG. 4, when part 31*d* is rotated to advance thread 31*e* into thread 31*f*, whereby surface 31*g* is held with adjustable force against the ball surface. This construction enables provision of a degree of clamping friction sufficient to prevent unwanted ball and cymbals further tilt. Tilting of the cymbals and ball to another secured position, normally requires loosening rotation of the part 31*d*, such tilting of tube 21 to selected position, and re-tightening of the part 31*d*. Such part holding friction may be regarded as stiction provided by the assembly, and enabling the cymbals player to quickly adjust his cymbals tilt position, as during a performance. Part 31*d* may be regarded as a tubular nut, with a clamping surface 31*g* that preferably but not necessarily has a curvature matching or approximately matching that of the ball surface. The centers of curvature of the ball and of surface 31*g* are preferably about the same, to provide matching surface interengagement as in FIG. 4 clamp-up condition. FIG. 5 shows 31*g* in loosened (un-clamped) condition.

The ball 16 is typically connected to or integral with stem 17 that projects upwardly within upper tube 21, and is connected thereto by fasteners 46, to support the cymbals.

The ball and socket are preferably configured to provide through openings or passages 50 and 51, as shown, to pass a cymbals actuator cable 52. A protective plastic sheath 53 extends within the opening 50 and is shown as extending upwardly from the top 54 of a cable guide or centering tube 55. The latter is also connected to tube 20 by fasteners 29. Accordingly, the cable is centered by guide 55 relative to socket opening 51.

It will be understood that the socket may be located to tilt relative to the ball, i.e. the ball may have fixed position relative to stand lower portion 11.

Figure 2:
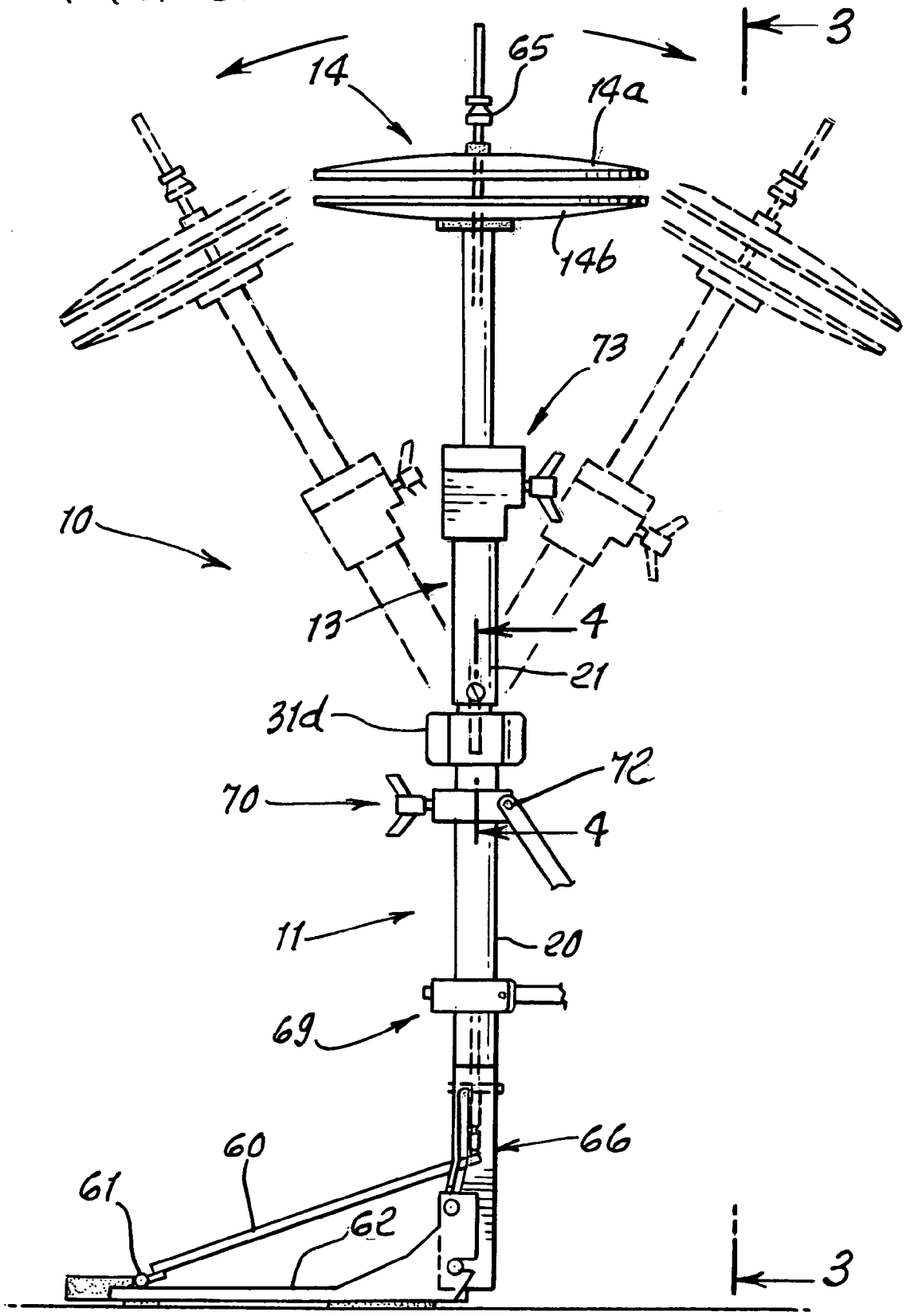
FIG. 2 is a section, in elevation, taken on lines 2-2 of FIG. 1.
Figure 3:
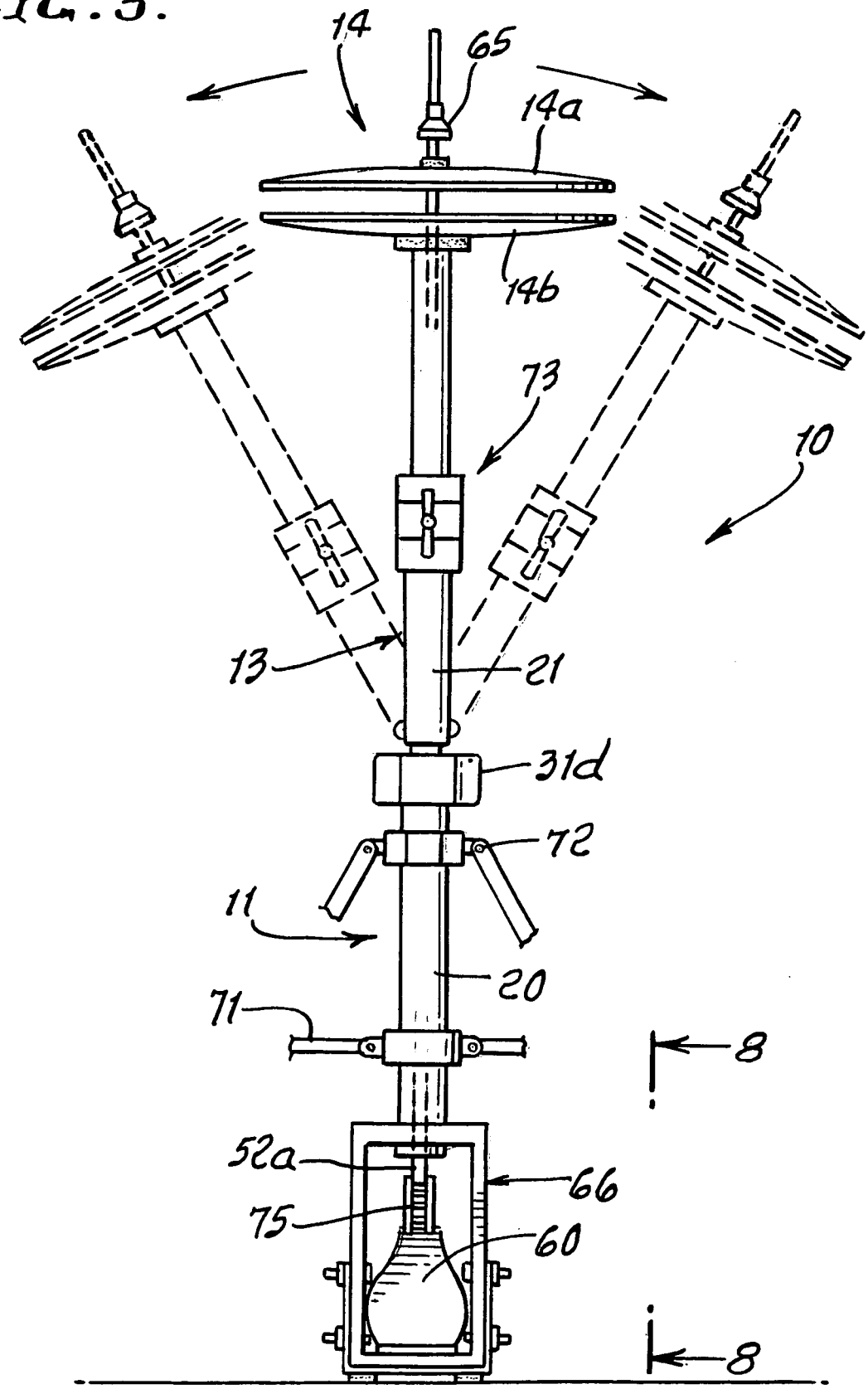
FIG. 3 is an elevation taken on lines 3-3 of FIG. 2.
Figure 8:
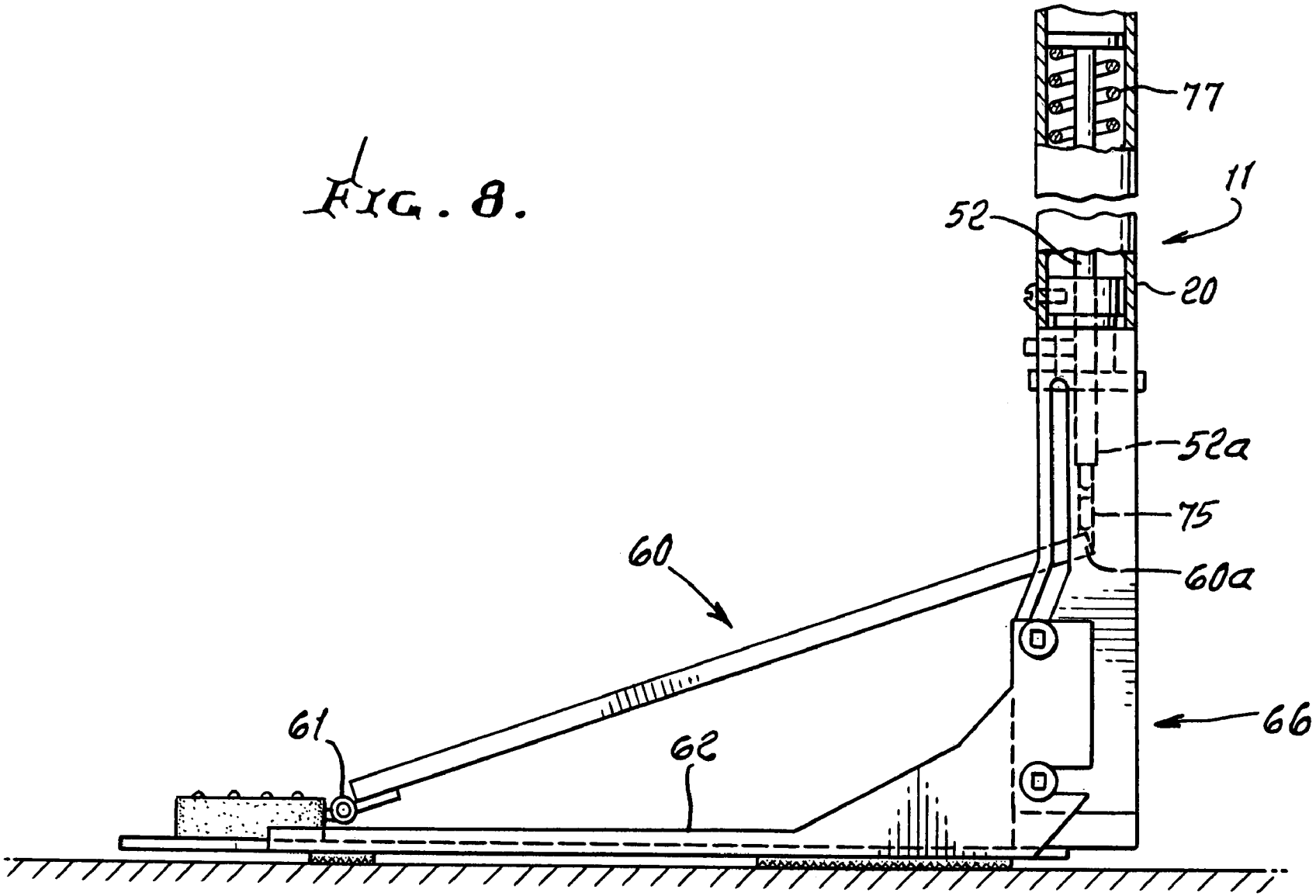
FIG. 8 is an enlarged elevation taken on lines 8-8 of FIG. 3.

FIGS. 1, 2 and 8 show a foot pedal 60 pivotally supported at 61 on a base 62. The pedal forward end 60*a* has connection at 75 to the lower end 52*a* of actuator cable 52. The upper end of the cable is controllably attached at 65 to the upper cymbals disc. See for example U.S. Pat. No. 5,668,332. A pedal return spring is shown at 77. A frame 66 associated with the pedal and base provides a support for the stand lower portion 11; and stand legs 67 and 68 diverge as shown from connections at 69 and 70 to the stand lower portion 11, to support same. Said leg divergence is to overall extent that exceeds cymbals tilt enabled by the swivel joint. Hinged connectors to the legs are provided at 71 and 72. A height adjustment for the stand upper portion 13 is provided at 73.

As shown, the part 31*d* provides a clamp, and is integrated with the socket element 31.

I claim:

1. A swiveling cymbals stand, comprising a) a stand lower portion, and leg means supporting said lower portion to extend upright, b) a stand upper portion to carry cymbals including discs one of which is movable relative to the other, c) a swivel joint interconnecting said upper and lower portions, allowing the upper portion to be displaced to a selected angle from vertical and to a selected azimuth angle, and to remain at said angles, d) and means for operating said cymbals including an actuator extending through said swivel joint, e) said swivel joint including ball and socket elements, having variable relative positions corresponding to stand upper portion selected angularity, the ball element connected to said stand upper portion to swivel therewith, the socket element connected to said stand lower portion to support the ball element, said elements having through openings to pass an elongated member defined by said actuator, f) there being upper and lower tubular guides extending with said openings to guide and protect said actuator as it moves endwise within said elements and guides.

2. The cymbals stand of claim 1 wherein said upper tubular guide consists of plastic material and projects downwardly through substantially the entirety of the ball element.

3. The cymbals stand of claim 1 wherein said means includes a foot pedal operatively connected to said actuator.

4. The cymbals stand of claim 1 including an adjustably tightenable clamp by which friction between the ball and socket, that provides resistance to pivoting, can be adjusted.

5. The cymbals stand of claim 4 wherein the ball has an outer surface and the clamp adjustably engages said outer surface.

6. The cymbals stand of claim 4 wherein the clamp is integrated with said socket element, to adjustably grip the ball.

7. The cymbals stand of claim 1 wherein the socket element includes a first part defining a seat for the ball, and a second part movable in one direction to clamp the ball against the seat, and movable in an opposite direction to allow ball swiveling relative to the seat.

8. The cymbals stand of claim 7 wherein the second part is rotatably supported by the first part.

9. The cymbals stand of claim 8, wherein the second part is a tubular nut having threaded engagement with the first part.

10. The combination of claim 9 wherein the tubular nut has a ball clamping surface spaced from said threaded engagement.

11. The combination of claim 1 including a support for said stand lower portion, and having legs that diverge to overall lateral extents exceeding cymbals tilt enabled by said swivel joint.

12. A swiveling percussion instrument stand, comprising a) a stand lower portion, and leg means supporting said lower portion to extend upright, b) a stand upper portion to carry a percussion instrument including parts one of which is movable relative to the other, c) a swivel joint interconnecting said upper and lower portions, allowing the upper portion to be displaced to a selected angle from vertical and to a selected azimuth angle, and to remain at said angles, d) and means for operating said instrument including an actuator extending through said swivel joint, e) said swivel joint including ball and socket elements, having variable relative positions corresponding to stand upper portion selected angularity, f) there being at least one tubular guide extending within openings defined by the ball and socket elements to closely guide and protect said actuator as it moves endwise within the elements and guide, the ball element carried to swivel within the socket element.

* * * * *